US005313525A

United States Patent [19]

Klasco

[11] Patent Number: 5,313,525

[45] Date of Patent: May 17, 1994

[54] ACOUSTIC APPARATUS WITH SECONDARY QUARTERWAVE RESONATOR

[75] Inventor: Michael A. Klasco, Berkeley, Calif.

[73] Assignee: Yamaha Corporation, Hamamatsu, Japan

[21] Appl. No.: 861,935

[22] Filed: Apr. 2, 1992

[51] Int. Cl.[5] ..... H04R 25/00

[52] U.S. Cl. ..... 381/159; 381/154; 381/156; 181/156

[58] Field of Search ..... 381/159, 156, 153, 154, 381/160, 162, 165, 89; 181/144, 145, 148, 150, 152, 155, 156

[56] References Cited

U.S. PATENT DOCUMENTS

| | | | |
|---|---|---|---|
| 2,815,087 | 12/1957 | Delort | 181/152 |
| 4,524,846 | 6/1985 | Whitby | 181/156 |
| 4,549,631 | 10/1985 | Bose | 181/156 |
| 4,733,749 | 3/1988 | Newman et al. | 181/152 |
| 4,987,564 | 1/1991 | Yokoyama | 367/140 |
| 5,010,977 | 4/1991 | Furukawa et al | 181/150 |
| 5,025,885 | 6/1991 | Froeschle | 181/156 |
| 5,150,417 | 9/1992 | Stahl | 381/154 |

FOREIGN PATENT DOCUMENTS

| | | | |
|---|---|---|---|
| 0314000 | 12/1988 | Japan | 381/154 |

OTHER PUBLICATIONS

Audio Engineering Society Preprint, "A Compound Loading Loudspeaker System: Simulation and Acoustic Characteristics in A Low Frequency Range", Noboru Kyouno, Nov. 1988.

Adamson B218F, 1989.

JBL Introduces SB-1 and SB-5 Control Series Sub--Bass Systems With Triple Chamber Bandpass, 1990.

*Acustica,* vol. 39, "Loudspeaker Enclosure To Simulate An Infinite Baffle", A. D. Broadhurst, pp. 316-322, 1978.

*Speaker Builder,* "Constructing a Sontek Subwoofer", Phil Todd, pp. 20-25, Feb. 1985.

Bose Professional Wave Systems, 1987.

Acoustic Research STC 660 Subwoofer Satellite System, 1988.

EAW 1988 New Product KF600, 1988.

Renkus-Heinz Model Sub-152, 1988.

JBL 4688 Sub-Bass System, Mar. 1990.

JBL 4688, 4688-4 TCB Subwoofer System, Aug. 1990.

SR2 System Subwoofer, undated.

Bose 302 Tandem-Tuned Bass System, undated.

ADC Soundshaper 3025 3-Piece Speaker System, undated.

JBL Technical Notes, vol. 1, No. 19, "Sub-Bass Systems Using Triple Chamber Bandpass (TCB) Technology", undated.

*Primary Examiner*—Curtis Kuntz

*Assistant Examiner*—Huyen D. Le

*Attorney, Agent, or Firm*—Spensley Horn Jubas & Lubitz

[57] ABSTRACT

A loudspeaker system for use as a subwoofer or other bass speaker system utilizes an enclosure with at least one speaker mounted therein and a port to form a bass reflex system. The bass reflex system is tuned to a selected low frequency range so that the acoustical output within such low range of the frequency spectrum of the loudspeaker system is enhanced while minimizing speaker cone excursion and distortion. Whereas the bass reflex speaker system loads the speaker at the selected low frequency range, a waveguide in the form of a quarterwave resonator is included in the loudspeaker system for loading the speaker at a higher frequency range which is still within the frequency range of the speaker system, so that acoustical output is enhanced and speaker cone excursion and distortion are minimized at the upper end of the frequency range. The resonator is designed to function as a quarterwave resonator within the upper frequency range. The resonator may comprise a tube or duct, located within the speaker enclosure together with one or more speakers. The tube or duct extends from the speakers to an opening in the front of the enclosure. The volume within the enclosure and outside of the tube or duct combines with the speaker and a port in the enclosure to form the bass reflex portion of the system.

14 Claims, 8 Drawing Sheets

ACOUSTIC APPARATUS WITH SECONDARY QUARTERWAVE RESONATOR

BACKGROUND OF THE INVENTION

1. Field of the Invention

The present invention relates to loudspeaker systems, and more particularly to loudspeaker systems such as subwoofers for producing frequencies in the lower bass range.

2. History of the Prior Art

Loudspeaker systems such as subwoofer systems designed to produce frequencies in the lower bass range typically employ an enclosure system such as a bass reflex enclosure system which is tuned so that the speaker system can produce frequencies at the lower end of its spectrum without excessive speaker cone excursion and the distortion which typically results therefrom. In a typical bass reflex system, for example, a bass range speaker or woofer is mounted within an enclosure having a port for communicating with the outside of the enclosure. The enclosure is typically tuned to the low frequency range of 30–50 Hz, so that operation of the woofer in this frequency region reduces the amplitude of speaker cone motion and the air velocity in the port increases. The air spring in the enclosure is in resonance with the air mass in the port, and the overall output of the system is the vector sum of port radiation and cone radiation. Because the excursion requirements of the woofer transducer are considerably reduced, substantial output at the port tuning frequency can be realized with low distortion.

Bass reflex speaker systems of this type are not without their disadvantages. At higher frequencies, such as those approximately an octave above port tuning, the contribution from the port is minimal and the output is essentially from the speaker cone. Because most music material has greater program content in the frequency spectrum above 70 Hz, where cone excursion is at a maximum in the bass reflex design, alternative enclosure systems have been investigated.

One such alternative enclosure system is a double tuned bass reflex system in which the enclosure is configured to produce two air masses from a speaker mounted therein. Typically, the speaker is mounted at the front of the enclosure so as to face the interior and thereby produce a first air flow through a first port extending to the outside of the front of the enclosure from the interior thereof. A second port extending into the enclosure from the front thereof communicates with the rear of the speaker to produce a second air flow therethrough.

Another alternative enclosure system is the manifold bass reflex system. The manifold technique closely couples two direct radiators so that the outputs thereof add coherently. The resulting loading and the benefits that derive therefrom are effective up to about 70 Hz. At higher frequencies, the problem of excessive speaker cone excursion still remains. Also, such design requires at least two woofers, and tends to be relatively heavy.

A further alternative enclosure system is the triple chamber bandpass system which utilizes a manifold bass reflex system with the manifold cavity enclosed and ported. The basic configuration is identical to the manifold bass reflex configuration, except that the common cavity is enclosed where the two woofers face each other and a port is added which is tuned to an upper frequency. Two tunings are utilized, one at the low frequency limit of the intended bandpass range (within the outer subenclosures), and the other in a center chamber and tuned to the high frequency limit (below a few hundred Hz). There are two frequency ranges over which enclosure tunings help to reduce distortion by minimizing cone motion. All acoustical output from the system is by way of its port openings, which act effectively as acoustical low-pass filters and further reduce distortion. Dual transducers are employed in a push-push arrangement which reduces mechanical stresses and minimizes third harmonic distortion through cancellation of non-linearities.

It has been found that even with the double tuning of triple chamber bandpass systems, the speaker cone excursions between the lower and upper tunings (in the band between 30 and 50 Hz) can be substantial. A variation of such design has been devised in which one woofer is loaded by a sealed chamber and the second woofer is loaded by a vented chamber, with both woofers facing a common chamber that is ported. Output is by the ported chamber and the common chamber, and the sealed chamber prevents cone over-excursion at frequencies below the lower vent tuning. In addition to requiring at least two woofers, speaker systems of this type also require a relatively large and heavy enclosure, and yet have proven to be no more efficient than simpler designs.

A still further alternative enclosure system is the double tuned quarterwave resonator system in which a single speaker drives two air columns corresponding to quarter wavelengths at frequencies such as 25 Hz and 125 Hz. Each tuned column thus loads the adjacent side of the transducer at a different frequency band, reducing cone excursion for a given acoustic output. The difficulty with this approach is that it becomes impractical for extended bass response. For example, at least one commercially available system of this type is approximately 12 feet in length, with the lower tuned air column comprising approximately 9 feet of that length. Efficiency is relatively poor, frequency response is not very smooth and cone excursions are similar to those present in much simpler designs.

In a still further alternative enclosure system, a compound loaded speaker arrangement is used. There are two variations of this technique, both of which utilize an enclosure with two speakers, one in front of the other. The first speaker faces out of the enclosure, while the second speaker faces into the enclosure. In some designs, the first speaker is located at the end of a short tube, while in other designs, the speakers are mounted directly together, face to face. The Q values of such systems tend to be substantially increased, making it difficult to control transient response unless negative output impedance is used.

Accordingly, it would be desirable to provide an improved speaker system, particularly one designed for use with low frequencies such as in the case of subwoofer applications.

It would furthermore be desirable to provide an improved speaker system in which high output is realized with limited transducer excursion over the intended operating bandwidth. Such speaker system should also desirably provide a relatively smooth response, be relatively efficient, have good sensitivity, and be relatively small in size.

SUMMARY OF THE INVENTION

Briefly stated, the present invention provides a speaker system utilizing an enclosure loading technique that achieves relatively high acoustic output while reducing transducer excursion over the intended operating bandwidth. This is realized in systems according to the invention by combining a quarterwave tuned resonator with a bass reflex direct radiator speaker system. The quarterwave resonator is tuned to a higher frequency than the bass reflex tuning. As the bass reflex port unloads with increasing frequency, the quarterwave resonator continues to load the transducer. As a result, acoustical output is substantial while at the same time speaker cone excursions are minimized over the entire frequency range of the speaker system.

In accordance with a feature of the invention, a negative output impedance drive amplifier can be employed to control speaker Q, thereby aiding in the control of transient response and reducing external sound energy from driving the speakers.

In accordance with a further feature of the invention, multiple drivers can be used in manifold or compound configurations, or both, in conjunction with the dual tuning technique in order to increase low frequency sensitivity and thermal power handling beyond single driver versions.

In speaker systems according to the invention, the low frequency band can be effectively loaded by conventional bass reflex tuning using either a vent or a passive radiator. The upper bass band can be effectively loaded using a quarterwave pipe resonator. Tuning at 120 Hz, for example, can be done within a space of approximately 30 inches. The two techniques of bass reflex tuning and quarterwave resonator tuning are combined using a unique configuration in accordance with the invention.

In a first embodiment according to the invention, a speaker is mounted at the back wall of an elongated, generally rectangular enclosure, and a tubular member extends forwardly from the front of the speaker to the front of the enclosure. The tubular member is configured to define an upper frequency tuning tube. A partition located slightly inside of the forward end of the enclosure and extending between the inner walls of the enclosure and the tubular member has four vents therein for communicating with a rear volume between the enclosures and the tubular member, and provides lower frequency tuning. The tubular member forms the quarterwave resonator and loads the front of the speaker cone, while the rear volume with the vented partition forms the bass reflex enclosure and loads the rear of the speaker cone.

In an alternative embodiment of a speaker system according to the invention, a rectangular enclosure extends in a direction of elongation between upper and lower ends thereof and has a speaker mounted therein on the bottom. An upper frequency tuning tube extends upwardly from the speaker to an intermediate portion of the interior of the enclosure, before curving toward an upper portion of the front surface of the enclosure where it terminates. A second opening at a lower portion of the front surface of the enclosure mounts a passive radiator for lower frequency tuning. The passive radiator may comprise a speaker cone. The use of a curved tube for upper tuning and a passive radiator for lower tuning provides for a system of reduced length in the second embodiment.

In a third embodiment of a speaker system according to the invention, the single speaker of the first embodiment is replaced by a pair of speakers, disposed face to face at the rear of the enclosure. The upper frequency tuning tube extends forwardly within the enclosure from the interface of the pair of speakers.

In a fourth embodiment of a speaker system according to the invention, the tubular member of the first embodiment is replaced by a duct of rectangular cross-section extending forwardly to the front of the enclosure from the rear wall thereof. The single speaker of the first embodiment is replaced by four speakers mounted in the four sides of the duct adjacent the rear wall of the enclosure.

In a fifth embodiment of a speaker system according to the invention, the partition of the first embodiment has the vents thereof replaced by hollow cylindrical ports extending into the rear volume, to provide lower frequency tuning. The rear volume is confined to the space between the tubular member and the interior side walls of the enclosure by a second partition which mounts the back end of the tubular member at the front of the speaker.

BRIEF DESCRIPTION OF THE DRAWINGS

A better understanding of the invention may be had by reference to the following description in conjunction with the accompanying drawings, in which.

DETAILED DESCRIPTION

Figure 1:
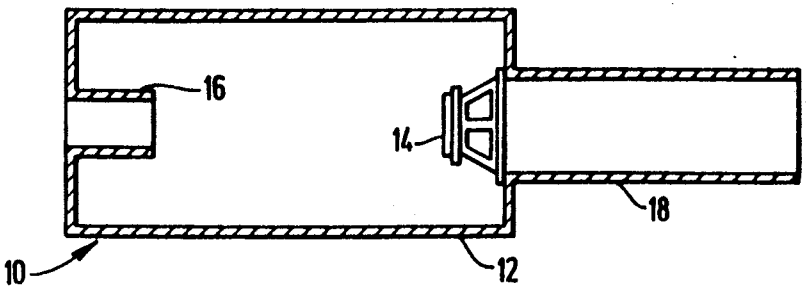
FIG. 1 is a diagrammatic representation of a speaker system with a secondary quarterwave resonator, in accordance with the invention.

FIG. 1 is a diagrammatic representation of a speaker system 10 in accordance with the invention. The speaker system 10 includes an enclosure 12 having a speaker or transducer 14 mounted therein. The enclosure 12 which is shown in side sectional view may be of rectangular configuration. For bass speaker system or subwoofer applications, the speaker 14 comprises a woofer. The enclosure 12 includes a vent or port 16 opposite the speaker 14. The port 16 may be of hollow cylindrical configuration.

The enclosure 12 together with the speaker 14 and the vent or port 16 comprises a bass reflex speaker system. Such bass reflex speaker system is tuned, such as by appropriate dimensioning or component placement, to provide bass reflex tuning at a low frequency in conventional fashion. This loads the rear of the speaker 14, such that the acoustical output is substantial with minimal distortion and speaker cone excursion when the speaker 14 produces frequencies at or relatively close to the tuning frequency of the bass reflex system.

The speaker system 10 is also provided with a quarterwave resonator 18, which extends from the speaker 14 outside of the enclosure 12 in the example of FIG. 1 and which may be of hollow cylindrical configuration. The quarterwave resonator 18 is tuned to a higher frequency than the bass reflex tuning. As a result, when the base reflex vent or port 16 unloads with increasing frequency, the quarterwave resonator 18 continues to load the speaker 14, but from the front of the speaker 14 rather than from the rear thereof.

Figure 2:
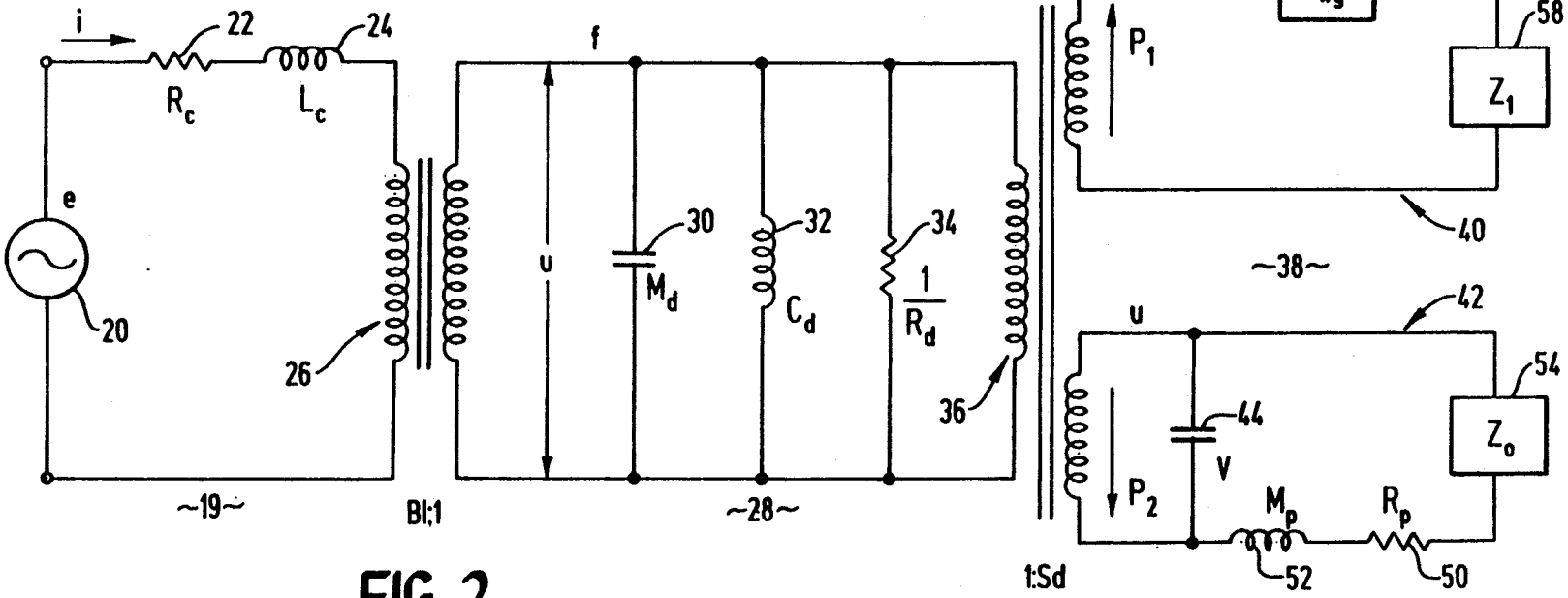
FIG. 2 is a schematic diagram of an electrical circuit equivalent of the speaker system of FIG. 1.

FIG. 2 is a schematic diagram of an electrical equivalent or analogous circuit model of the speaker system 10 of FIG. 1. The speaker system 10 of FIG. 1 can be divided into three different parts, which include (1) the electrical components of the speaker 14, (2) the mechanical components of the speaker 14, and (3) the enclosures 12 and 18 on each side of the speaker 14 which constitute the acoustic components.

In an electrical section 19 of the circuit of FIG. 2, the amplifier used to drive the speaker 14 of the speaker system 10 of FIG. 1 is represented as an ideal voltage source 20. The voltage source 20 generates a voltage difference e and a current i. The voice coil of the speaker 14 has a resistance $R_c$ represented by a resistor 22 and an inductance $L_c$ represented by an inductor 24. Because the current i through the coil of the speaker 14 creates a magnetic field which produces a force on the diaphragm of the speaker 14, the electrical section 19 of the circuit of FIG. 1 terminates in a transformer 26, through which it is connected to a mechanical section 28 of the circuit of FIG. 2. The ratio of turns in the transformer 26 is B1:1 where B1 is the product of magnetic flux density in the gap and the wire length of the coil in the gap. This is because current in the mechanical section 28 (the force exerted by the coil on the diaphragm) is equal to the product of B1 and the current i in the electrical section 19.

Force exerted by the coil on the diaphragm on the speaker 14 is represented by the current in the mechanical section 28. Diaphragm velocity is represented by the voltage across the mechanical section 28 side of the transformer 26. To create a diaphragm velocity, the external force on the diaphragm must oppose forces due to the inertia of the diaphragm mass $M_d$, the suspension resistance $R_d$ and compliance $C_d$ and the airload. The circuit components representing such influences comprise a capacitor 30, an inductor 32 and a resistor 34, coupled in parallel. The airload is represented by a transformer 36, inasmuch as the variables of an acoustic section 38 of the circuit of FIG. 2 are pressure and volume velocity.

The electrical section 19 and the mechanical section 28 of the circuit of FIG. 2, which have been described, are also applicable to a double chambered woofer speaker system and to a double tuned quarterwave resonator speaker system. However, the acoustic section 38 is different in the case of the present invention. This is primarily due to differences in the enclosure system. In the case of the present invention, one side of the speaker or other driver is presented with a vented chamber (the enclosure 12) and the other side with a waveguide (the resonator 18).

To a first approximation, the pressure on one side of the diaphragm of the speaker 14 is independent of the pressure on the other side, for a particular diaphragm velocity u. Therefore, the acoustic components in front and in back of the speaker are modeled as separate circuits 40 and 42 driven in parallel by the diaphragm velocity. Pressures $P_1$ and $P_2$ at the front and rear of the diaphragm are represented by voltages in the circuits 40 and 42. The volume velocity of air displaced by the diaphragm is represented by a current. The ratio of turns in the transformer 36 is 1:Sd, where Sd is the diaphragms effective surface area. The current (volume velocity) in the acoustical section 38 is equal to the product of Sd and the voltage of the mechanical section 28 (diaphragm velocity).

Within the vented chamber defined by the enclosure 12 and the vent or port 16 of the speaker system 10 of FIG. 1, the air displaced by the diaphragm of the speaker 14 either joins the air in such chamber (becomes charge on a capacitor in the circuit analogy) or flows through the vent or port 16. Therefore, the chamber and vent are modeled as circuit elements in parallel. The pressure in the chamber is determined by the quantity of air in the chamber (the charge on the capacitor) and the volume V of the chamber (the capacitance of the capacitor). The volume V is represented by a capacitor 44 in the circuit 42. The air which flows through the vent or port 16 must overcome a resistance $R_p$ represented by a resistor 50 and the inertia of the air in the port (inductance of value $M_p$, represented by an inductor 52). The air flowing through the vent 16 meets infinite space. The acoustic impedance $Z_O$ (the ratio of pressure at the vent mouth to volume velocity through the vent) which is seen by air flowing out of the vent is not a ratio of polynomials (in a frequency variable), and hence cannot be modeled by a simple lumped circuit. Therefore, this element is represented by a block 54.

The quarterwave resonator or waveguide 18 is represented by the circuit 40. The impedance $Z_{wg}$ associated with the flow of air through the waveguide is not a ratio of polynomials in frequency, and therefore cannot be represented as a simple lumped circuit. Instead, it is represented by a block 56. The circuit 40 also includes an impedance $Z_1$, represented by a block 58 in series with the block 56.

Figure 3:
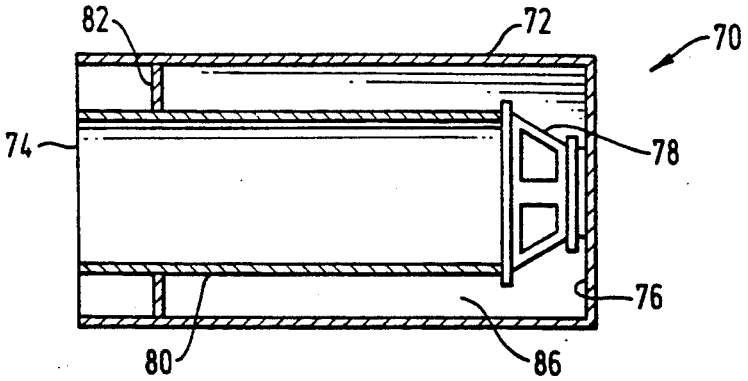
FIG. 3 is a side sectional view of a first embodiment of a speaker system in accordance with the invention.
Figure 4:
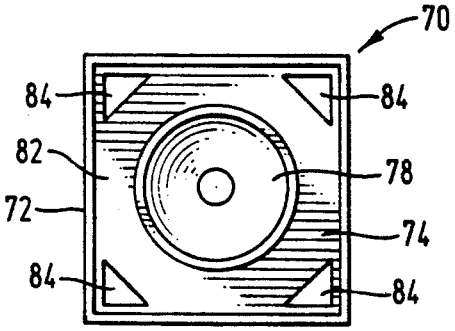
FIG. 4 is a front view of the speaker system of FIG. 3.

FIGS. 3 and 4 show one embodiment of the invention in the form of a speaker system 70. Like the speaker system 10 of FIG. 1, the speaker system 70 of FIGS. 3 and 4 has an enclosure together with a speaker and a vent or port forming a bass reflex speaker system. The enclosure comprises an elongated rectangular enclosure 72 extending in the direction of elongation thereof between a front 74 and an opposite rear surface 76. A speaker 78 is mounted within the enclosure 72 adjacent the rear surface 76 thereof, and faces forwardly toward the front 74. A tubular member 80 of hollow cylindrical configuration extends forwardly from the front of the speaker 78 to the front 74 of the enclosure 72. A partition 82 located slightly inside of the front 74 of the enclosure 72 extends between the inner walls of the enclosure 72 and the outer surface of the tubular member 80. The partition 82 has a series of four vents 84 therein at the corners of the square-shaped partition 82, as shown in FIG. 4.

The vents 84 in the partition 82 correspond to the vent or port 16 of the speaker system 10 of FIG. 1. Such vents 84 communicate with a rear volume 86 which extends from the partition 82 to the rear surface 76 between the inner walls of the enclosure 72 and the tubular member 80. The rear volume 86 communicates with the rear of the speaker 78. Together with the speaker 78 and the vents 84, the rear volume 86 defines a bass reflex system which provides low frequency tuning so as to load the speaker 78 at the lower range of the frequency spectrum of the speaker system 70.

In addition to defining one of the boundaries of the rear volume 86, the tubular member 80 comprises a waveguide in the form of a quarterwave resonator, corresponding to the resonator 18 of the speaker system 10 of FIG. 1. As such, the tubular member 80 is configured and dimensioned to define an upper frequency tuning tube which loads the front of the cone of the speaker 78 at the higher frequency range to which the tubular member 80 is tuned.

Figure 5:
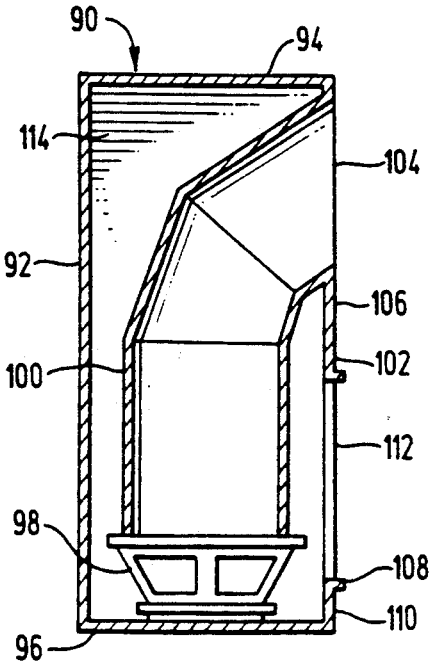
FIG. 5 is a side sectional view of a second embodiment of a speaker system in accordance with the invention.
Figure 6:
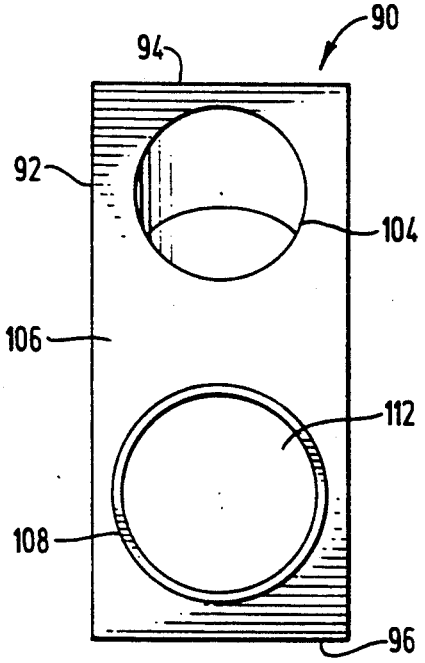
FIG. 6 is a front view of the speaker system of FIG. 5.

FIGS. 5 and 6 show an alternative embodiment in the form of a speaker system 90 in accordance with the invention. The speaker system 90 includes a rectangular enclosure 92 extending in a direction of elongation between upper and lower ends 94 and 96 thereof. A speaker 98 is mounted on the lower end 96 of the enclosure 92 and faces upwardly toward the upper end 94. A hollow upper frequency tuning tube 100 extends upwardly from the speaker 98 to an intermediate portion 102 of the interior of the enclosure 92, before curving toward an upper portion 104 of a front surface 106 of the enclosure 92, where the tuning tube 100 terminates.

An opening 108 at a lower potion 110 of the front surface 106 of the enclosure 92 mounts a passive radiator 112 for lower frequency tuning. The passive radiator 112 may comprise a speaker cone.

The interior of the enclosure 92 defines a volume 114 between the inner surface of the enclosure 92 and the outer surface of the tuning tube 100. The volume 114 combines with the speaker 98 and the passive radiator 112 to form a bass reflex system. The volume 114 is dimensioned and configured to provide the desired low frequency tuning for loading the rear of the cone of the speaker 98 at a low frequency range. The passive radiator 112 corresponds to the vent or port 16 of the speaker system 10 of FIG. 1. The tuning tube 100 is dimensioned and configured to provide the desired upper frequency tuning, so that the front of the cone of the speaker 98 is loaded at a desired upper frequency band.

Figure 7:
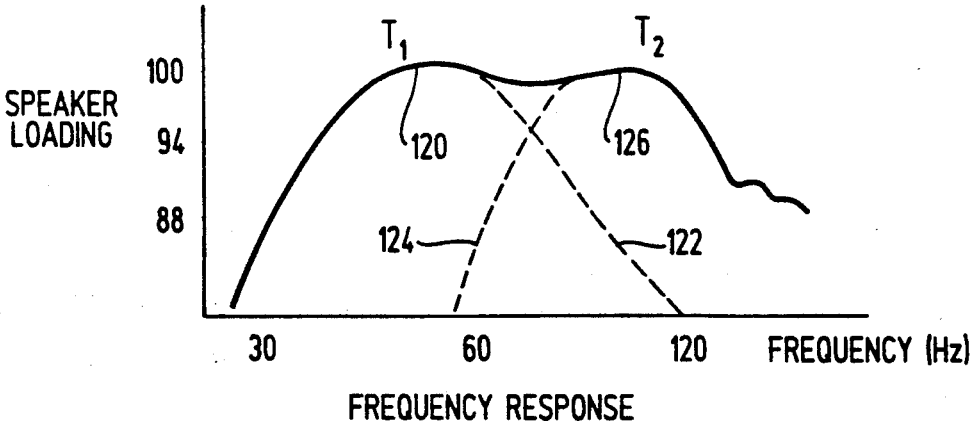
FIG. 7 is a diagrammatic plot of the frequency response of the speaker systems of FIGS. 3–6.

FIG. 7 is a diagrammatic plot of the frequency response of the speaker systems 70 and 90 of FIGS. 3–6. The plot of FIG. 7 is of speaker loading as a function of frequencies produced by the speaker. In the case of a speaker system acting as a subwoofer, the frequency spectrum produced by the speaker typically extends from a low end at or close to 20 Hz to a high end somewhat greater than 120 Hz.

The plot of FIG. 7 is shaped by the speaker loading effects produced by the bass reflex system tuned to a lower tuning frequency $T_1$ and by the quarterwave resonator tuned to the higher tuning frequency $T_2$. As shown in FIG. 7, the loading effects of the bass reflex system begin at a frequency at or slightly below 30 Hz and increase to a peak 120 at approximately 50 Hz. Following that, the loading decreases with increasing frequency along a dotted line 122. The loading effects of the upper frequency tuning of the quarterwave resonator begin at a frequency of approximately 60 Hz and increase along a dotted line 124 with increasing frequency to a peak 126 at approximately 100 Hz. Thereafter, the effects of the high frequency tuned quarterwave resonator gradually decrease with increasing frequency.

It will be seen from FIG. 7 that because of the overlapping effects of the lower frequency tuned bass reflex system and the higher frequency tuned quarterwave resonator, the frequency response of the speaker system remains high over much of the frequency spectrum of the speaker system. This allows for high acoustical output with minimal speaker cone excursion, and resulting minimal distortion.

It will also be appreciated that speaker systems according to the invention such as the systems 70 and 90 of FIGS. 3–6 provide the excellent frequency response characteristic of FIG. 7 in an enclosure package which is of relatively simple and inexpensive configuration and of relatively compact size. The quarterwave resonator is tuned to the higher frequency spectrum such that the length thereof need not exceed several feet (typically 2 feet–3 feet). At the same time, the bass reflex portion of the speaker system provides tuning over the lower portion of the frequency spectrum using the usual compact bass reflex configuration.

Figure 8:
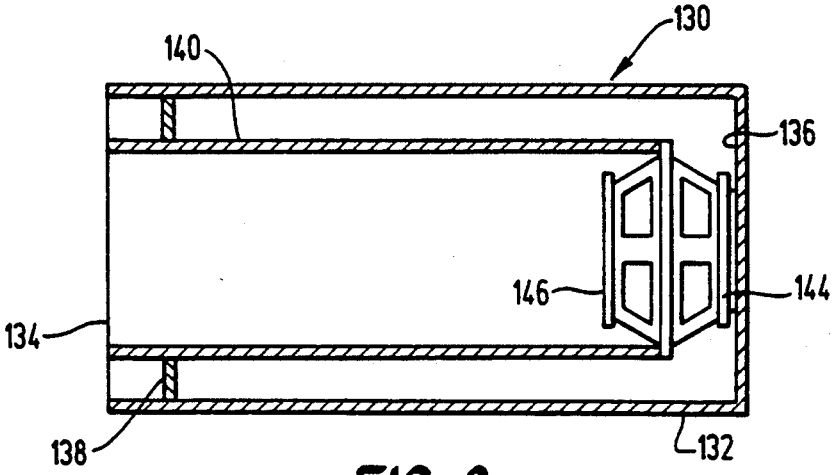
FIG. 8 is a side sectional view of a third embodiment of a speaker system in accordance with the invention.
Figure 9:
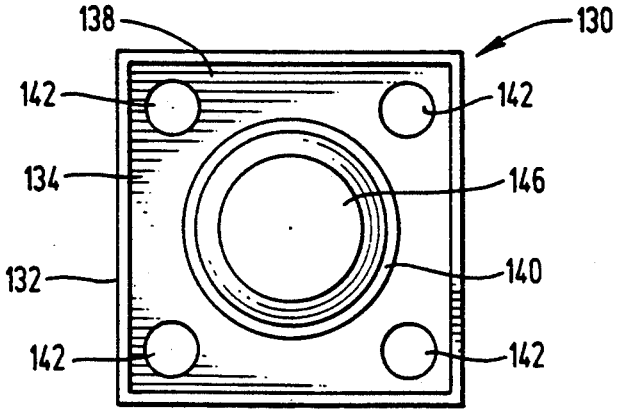
FIG. 9 is a front view of the speaker system of FIG. 8.

FIGS. 8 and 9 show a third embodiment of the invention in the form of a speaker system 130. The speaker system 130, which is similar to the speaker system 70 of FIGS. 3 and 4, has an elongated rectangular enclosure 132 extending between a front 134 and a rear surface 136. A partition 138 disposed slightly inside of the front 134 extends from the inner surfaces of the enclosure 132 to the outer surface of a tubular member 140. The partition 138 has four different vents 142 therein which correspond to the vent or port 16 in the speaker system 110 of FIG. 6. Unlike the vents 84 which are at the corners of the partition 82 in the speaker system 70 of FIGS. 3 and 4, the vents 142 are spaced apart from the four corners of the partition 138.

Whereas the speaker system 70 of FIGS. 3 and 4 has the single speaker 78 mounted on the rear surface 76 of the enclosure 72 at the inner end of the tubular member 80, the speaker system 130 of FIGS. 8 and 9 has a pair of speakers 144 and 146 mounted in a similar location. The first such speaker 144 is mounted on the rear surface 136 of the enclosure 132 so that the tubular member 140 extends outwardly therefrom. At the same time, the speaker 146 is mounted in face-to-face relation with the speaker 144.

Figure 10:
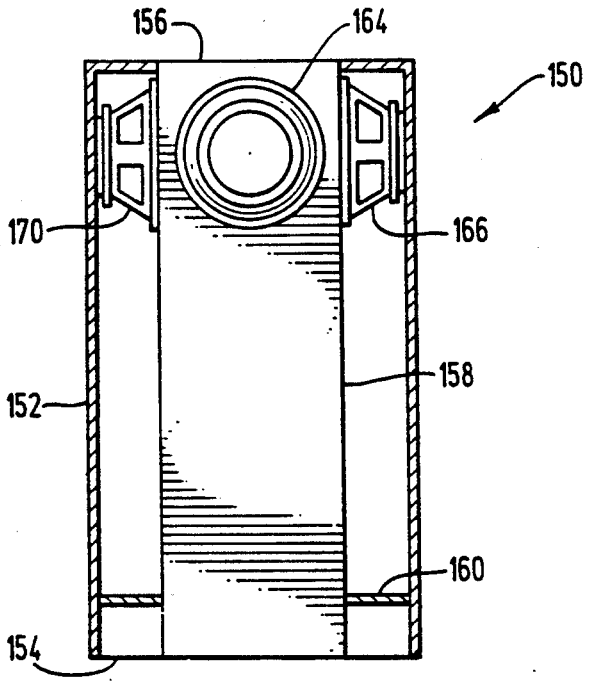
FIG. 10 is a side sectional view of a fourth embodiment of a speaker system in accordance with the invention.
Figure 11:
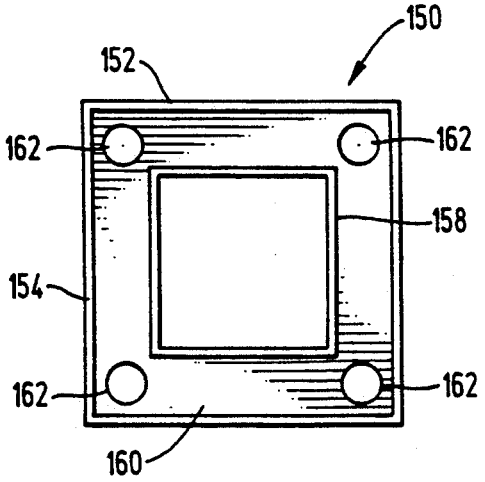
FIG. 11 is a front view of the speaker system of FIG. 10.
Figure 12:
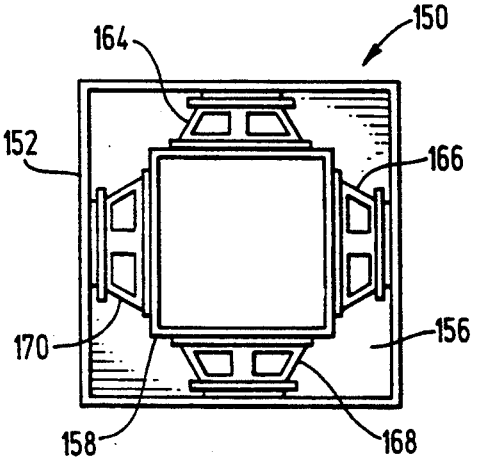
FIG. 12 is a view similar to that of FIG. 11, but with a partition removed to illustrate the internal configuration of the speaker system.

FIGS. 10–12 show a speaker system 150 comprising a fourth embodiment in accordance with the invention. Like the speaker system 70 of FIGS. 3 and 4, the speaker system 150 has an elongated rectangular enclosure 152 extending between a front 154 and a rear surface 156 thereof. A hollow duct 158 of rectangular cross-section extends forwardly from the rear surface 156 to the front 154, and forms an upper tuning duct in the embodiment of FIGS. 10–12. A partition 160 disposed just inside of the front 154 extends between the inner surfaces of the enclosure 152 and the outer surfaces of the duct 158. The partition 160 has four different vents 162 therein. Like the vents 142 of the speaker system 130 of FIGS. 8 and 9, the vents 162 are of circular configuration and are spaced by small distances from the four outer corners of the partition 160.

The speaker system 150 of FIGS. 10–12 is provided with four different speakers 164, 166, 168 and 170 which surround the duct 158 at an inner end thereof adjacent the rear surface 156 of the enclosure 152. Each of the speaker 164, 166, 168 and 170 is mounted on a different one of the four different surfaces of the duct 158 so as to face the interior of the duct 158.

Figure 13:
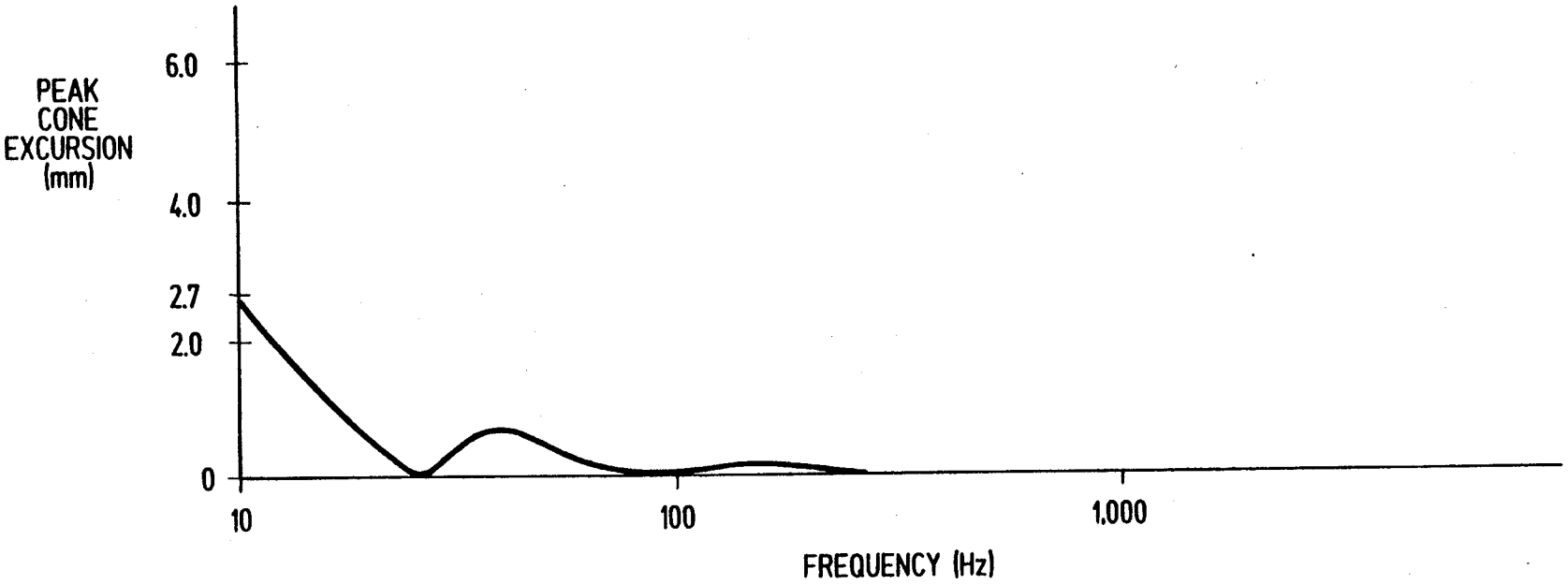
FIG. 13 is a plot of peak speaker cone excursion as a function of frequency for a speaker system with a secondary quarterwave resonator, in accordance with the invention.

FIG. 13 is a plot of peak speaker cone excursion as a function of frequency for a speaker system with a secondary quarterwave resonator in accordance with the invention. The peak cone excursion was measured in millimeters between excursions of the cone in opposite directions at the various frequencies. A voltage of 2.83 volts was applied so as to provide one watt of power to the speaker at an 8 ohm load.

It will be seen from FIG. 13 that the peak cone excursion has a maximum value of approximately 2.7 mm at 10 Hz, from which the peak cone excursion decreases to zero and then increases slightly before again decreasing to essentially zero at a frequency just under 100 Hz.

For purposes of comparison, several of the prior art speaker systems previously discussed were similarly energized with 1 watt of power at 8 ohms of load, and the peak cone excursion was measured as a function of frequency. The peak cone excursions for double chamber, wave cannon and ported box woofer type speaker systems had plots which were very similar to but slightly greater than the plot shown in FIG. 13.

Figure 14:
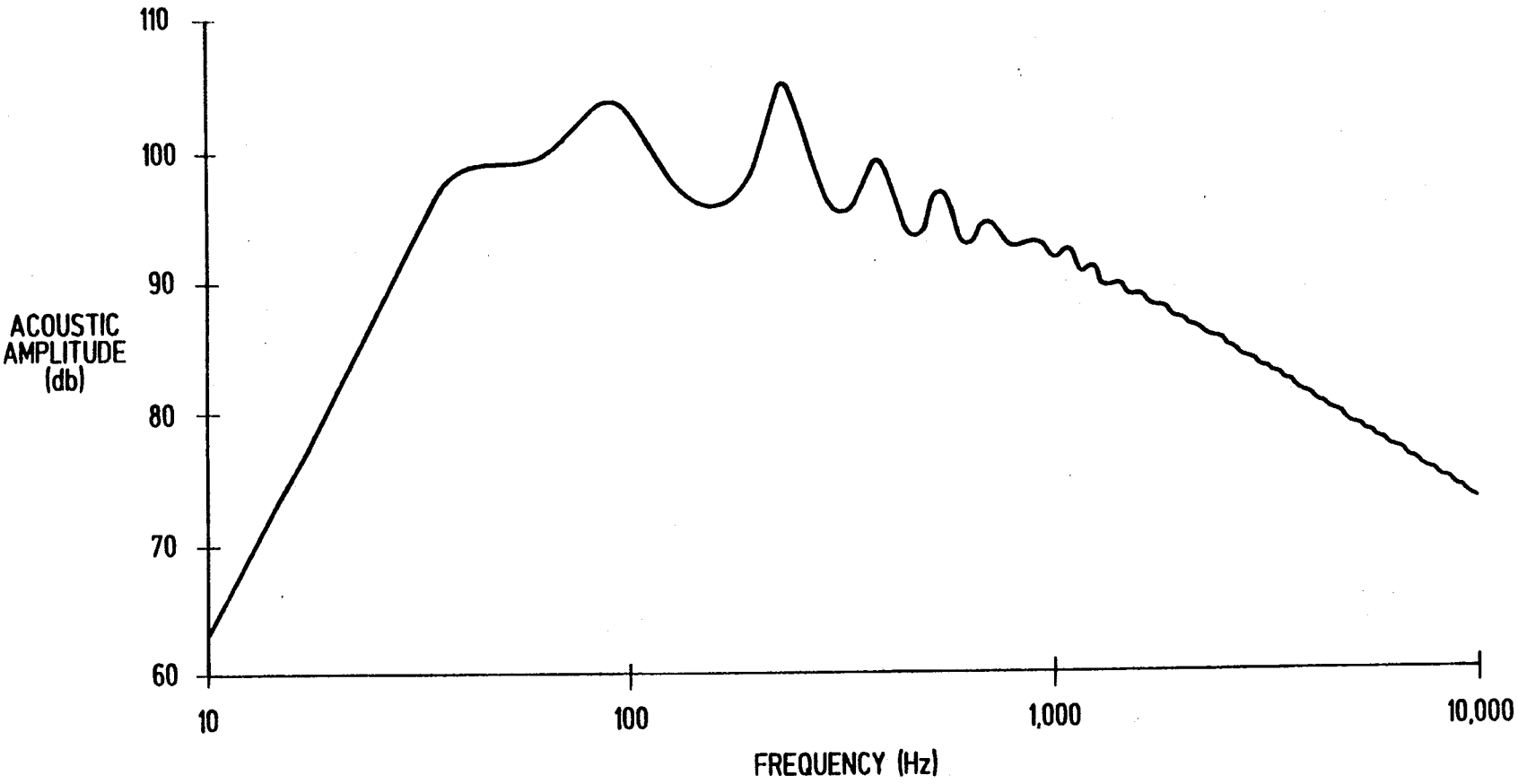
FIG. 14 is a plot of acoustic amplitude as a function of frequency for a speaker system with a secondary quarterwave resonator, in accordance with the invention.

FIG. 14 is a plot of acoustic amplitude in decibels as a function of frequency for the speaker system in accordance with the invention. Again, 2.83 volts were applied in order to apply 1 watt of power to the speaker at 8 ohms of loading. Acoustic amplitude was measured directly in front of the speaker enclosure at a distance of one meter from the front of the enclosure. As shown in FIG. 14, the acoustic amplitude increases from approximately 63 db at 10 Hz to a value close to 100 db at a frequency just under 100 Hz. Thereafter, the plot fluctuates somewhat as it undergoes a gradual decrease in value with increasing frequency.

Acoustic amplitude was plotted as a function of frequency under the same conditions used in connection with FIG. 14, for some of the prior art speaker systems previously described. A ported box woofer-type speaker system was found to produce a plot similar to but of slightly less amplitude than the plot of FIG. 14. A wave cannon-type speaker system was found to provide a plot similar to that shown in FIG. 14 but with very pronounced negative peaks occurring at frequencies above 100 Hz. A double chamber-type speaker system was found to produce a plot which was generally similar to that shown in FIG. 14 to a frequency just above 100 Hz, at which point the plot decreased rapidly to a value of approximately 60 db at a frequency of 1,000 Hz.

Figure 15:
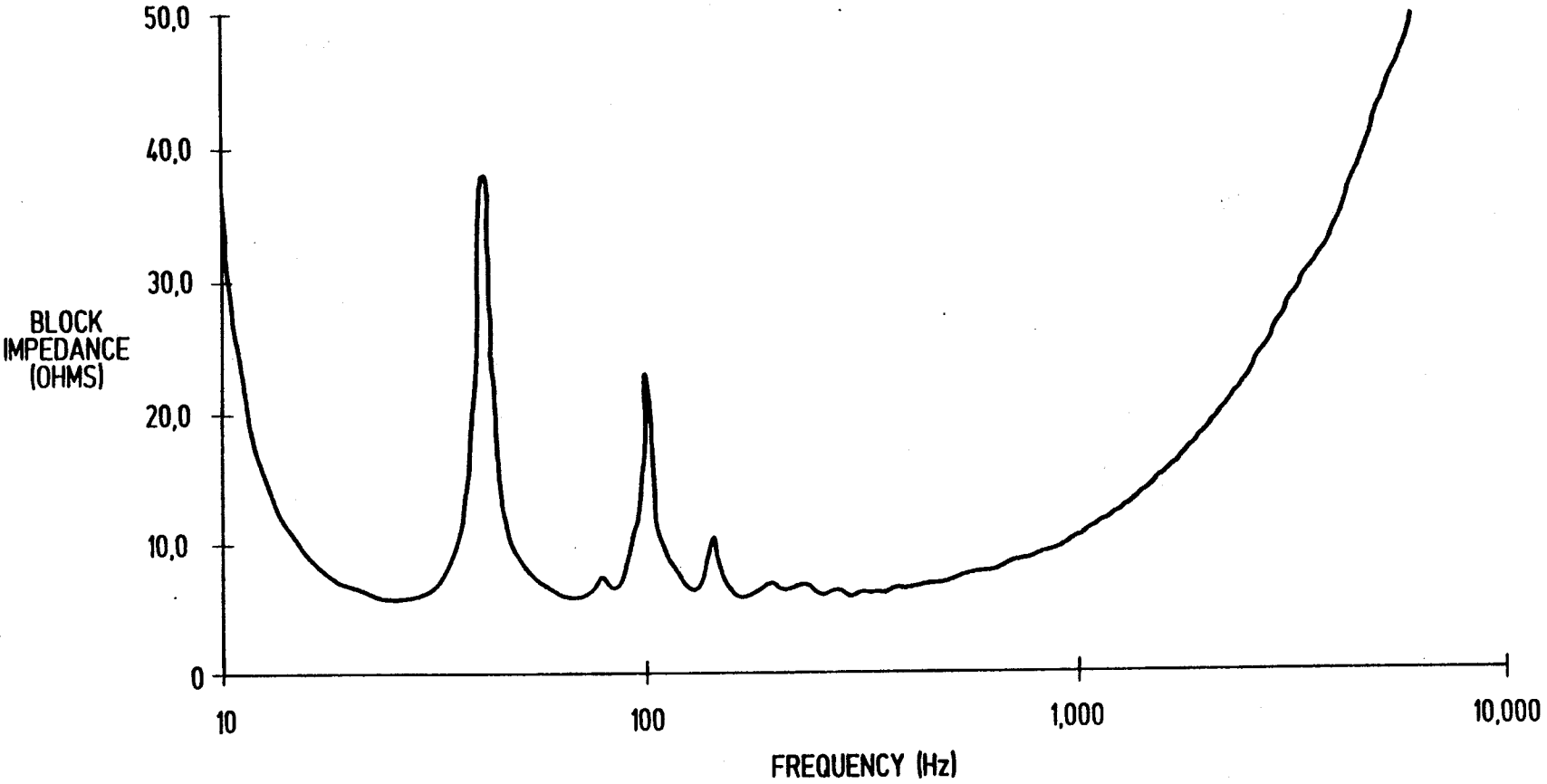
FIG. 15 is a plot of block impedance as a function of frequency for a speaker system with a secondary quarterwave resonator, in accordance with the invention.

FIG. 15 is a plot of block impedance in ohms as a function of frequency for the speaker system in accordance with the invention. The block impedance is the electrical impedance of the speaker coil with the speaker mounted within and affected by the speaker system according to the invention. As shown in FIG. 15, the block impedance twice decreased and then peaked as the frequency increased from 10 Hz to 100 Hz. Above 100 Hz, the block impedance again dropped to a value of approximately 7 ohms before gradually increasing to approximately 10 ohms at 1,000 Hz and then to approximately 50 ohms at a frequency slightly less than 10,000 Hz.

The block impedance was plotted as a function of frequency using the same operating conditions that were used in the case of FIG. 15, for several of the prior art speaker systems previously described. It was found that the wave cannon-type speaker system produced a plot which very closely followed the plot shown in FIG. 15. The double chamber-type speaker system produced a plot which closely followed that shown in FIG. 15, with the exception that the peak occurring at approximately 100 Hz in FIG. 15 occurred at a slightly higher frequency and had a greater value. The ported box woofer-type speaker system produced a plot similar to that shown in FIG. 15, with the exception that the two peaks occurring below and at approximately 100 Hz in FIG. 15 combined into a single large peak at a frequency therebetween.

Figure 16:
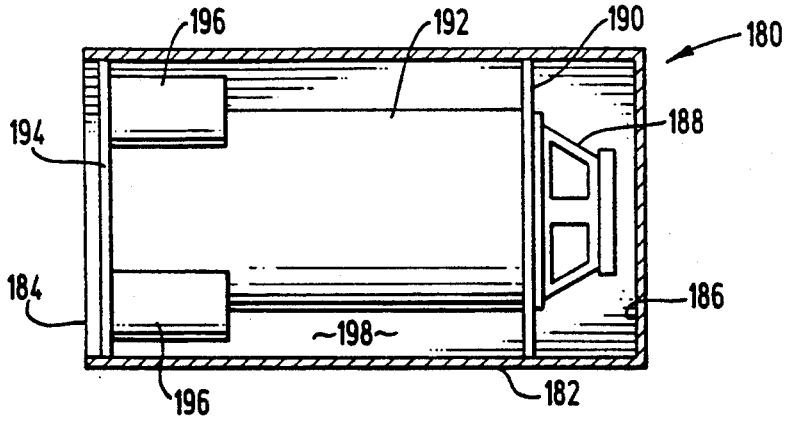
FIG. 16 is a side sectional view of a fifth embodiment of a speaker system in accordance with the invention.
Figure 17:
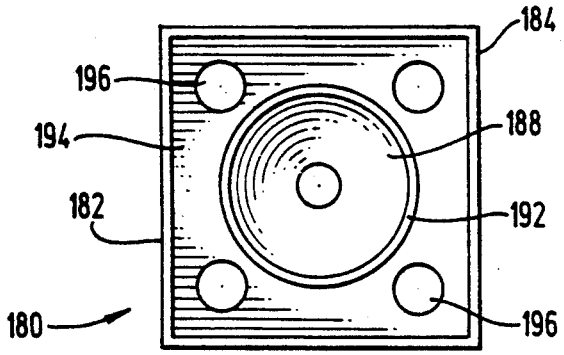
FIG. 17 is a front view of the speaker system of FIG. 16.

FIGS. 16 and 17 show a fifth embodiment of the invention in the form of a speaker system 180. The speaker system 180, which is similar to the speaker system 70 of FIGS. 3 and 4, has an elongated rectangular enclosure 182 extending in the direction of elongation thereof between a front 184 and an opposite rear surface 186. A speaker 188 is mounted within the enclosure 182 adjacent the rear surface 186 thereof. A partition 190 extending between the inner walls of the enclosure 182 is disposed forwardly of the rear surface 186 and at the front of the speaker 188. The partition 190 mounts the rear end of a hollow cylindrical tubular member 192. The tubular member 192 extends forwardly from the partition 190 and the front of the speaker 188 to a partition 194 disposed just inside of the front 184 of the enclosure 182. The partition 194 extends between the inner walls of the enclosure 182 and the outer surface of the tubular member 192 at the forward end of the tubular member 192.

The partition 194 is provided with four rearwardly extending hollow cylindrical ports 196 adjacent the corners of the square-shaped partition 194. The ports 196 which extend from circular aperatures on the partition 194 communicate with a rear volume 198 which extends from the partition 194 to the partition 190 between the inner walls of the enclosure 182 and the tubular member 192. In addition to defining one of the boundaries of the rear volume 198, the tubular member 192 comprises a waveguide in the form of a quarterwave resonator.

Figure 18:
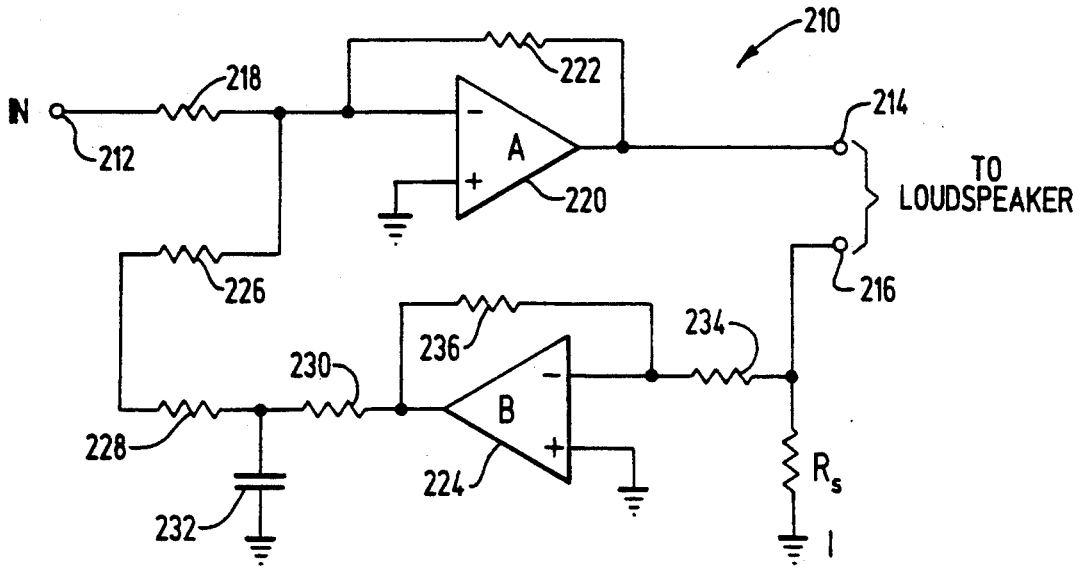
FIG. 18 is a schematic diagram of a negative impedance drive amplifier which may be used to drive the speakers of the various speaker systems described herein.

Any of the speaker systems described herein may be advantageously used with a negative impedance drive amplifier of the type described in U.S. Pat. No. 4,987,564 of Yokoyama, which patent issued Jan. 22, 1991 and is commonly assigned with the present application. As described in the Yokoyama patent, a speaker system comprised of a resonator having a resonance radiation unit and a vibrator in the form of a speaker can have the speaker advantageously driven by a negative impedance drive amplifier. This has the effect of reducing or eliminating the internal impedance inherent to the speaker. An example of a negative impedance drive amplifier 210 of the type described in the Yokoyama patent is shown in FIG. 18. The negative impedance drive amplifier 210 can be used to drive the speakers of any of the speaker systems described herein in advantageous fashion.

Referring to FIG. 18, the negative impedance drive amplifier 210 has an input terminal 212 coupled to receive an acoustical signal to be applied to a loudspeaker. The loudspeaker is coupled to a pair of terminals 214 and 216 of the drive amplifier 210. The input terminal 212 is coupled through a resistor 218 to a negative input terminal of an operational amplifier 220 which has a positive input thereof grounded. The operational amplifier 220 has an output coupled to the terminal 214 as well as through a feedback loop including a resistor 222 to the negative input terminal. The negative input terminal of the operational amplifier 220 is also coupled to the output of an operational amplifier 224 via a serial arrangement of resistors 226, 228 and 230. A junction between the resistors 228 and 230 is coupled to ground through a capacitor 232. A positive input of the operational amplifier 224 is grounded, and a negative input is coupled to the terminal 216 via a resistor 234. The output of the operational amplifier 224 is coupled to the negative input thereof through a feedback loop including a resistor 236. In addition to being coupled to the resistor 234, the terminal 216 is coupled to ground through a resistor $R_S$.

In operation, the audio signal at the input terminal 212 is coupled to the loudspeaker terminals 214 and 216 through the operational amplifier 220 which provides a gain "A". The current through the voice coil of the loudspeaker is detected by the resistor $R_S$, and such current is positively fed back to the operational amplifier 220 via a feedback circuit which includes the operational amplifier 224. The operational amplifier 224 provides a gain of "B". The capacitance-resistance circuit comprised of the capacitor 232 and the resistors 228 and 230 determines the frequency characteristic of the feedback circuit having the operational amplifier 224 therein.

The output impedance of the drive amplifier 210 of FIG. 8, as presented to the loudspeaker, is expressed by the equation:

$$Z_0 = R_S(1 - AB)$$

where $Z_0$ is the drive amplifier output impedance. If AB (the product of the gains of the operation amplifiers 220 and 224) is greater than 1, then the output impedance $Z_0$ can include an apparent negative resistance component. As described in the previously referred to Yokoyama patent, the negative impedance serves to control driving of the loudspeaker so as to reduce or eliminate the internal impedance inherent in the loudspeaker. Stated another way, the drive amplifier 210, when coupled to a loudspeaker system such as the loudspeaker systems described herein, serves to cancel air counteraction from the loudspeaker system's resonator when such resonator is driven. The drive amplifier 210 equivalently generates a negative impedance in the output impedance thereof, as described above.

While the invention has been particularly shown and described with reference to preferred embodiments thereof, it will be understood by those skilled in the art that various changes in form and details may be made therein without departing from the spirit and scope of the invention.

What is claimed is:

1. Acoustic apparatus comprising the combination of:

an enclosure having a front and an opposite rear wall;

a speaker mounted on the rear wall within the enclosure;

a hollow member disposed within the enclosure and extending from the speaker to the front of the enclosure; and a partition disposed between interior walls of the enclosure and an outer surface of the hollow member adjacent the front of the enclosure, the partition having at least one vent therein, wherein the enclosure has an interior volume outside of the hollow member which combines with the partition having at least one vent therein and the speaker to form a bass reflex speaker system tuned to a first frequency, and the hollow member forms a quarterwave resonator tuned to a second frequency higher than the first frequency.

2. Apparatus in accordance with claim 1, wherein the partition is of rectangular configuration with four corners and has four vents therein adjacent the four corners.

3. Apparatus in accordance with claim 1, wherein the hollow member comprises a hollow cylindrical tube.

4. Apparatus in accordance with claim 1, wherein the speaker comprises a pair of speakers mounted face-to-face on the rear wall within the enclosure.

5. Apparatus in accordance with claim 1, wherein the at least one vent comprises a hollow cylindrical port extending toward the rear wall from the partition.

6. Apparatus in accordance with claim 5, further including a second partition disposed between interior walls of the enclosure and the outer surface of the hollow member at a front of the speaker opposite the rear wall.

7. Acoustic apparatus comprising the combination of:

an enclosure having an elongated configuration including a front between opposite first and second ends;

a port at a first portion of the front of the enclosure;

a speaker mounted within the enclosure at the first end; and a hollow tube within the enclosure extending from the speaker to an opening in a second portion of the front, wherein the enclosure has an interior volume outside of the hollow tube which combines with the speaker and the port to form a bass reflex speaker system tuned to a first frequency and the tube forms a quarterwave resonator tuned to a second frequency higher than the first frequency.

8. Apparatus in accordance with claim 7, wherein the hollow tube extends straight from the speaker to an intermediate portion of the enclosure and then curves toward the front and terminates at the opening in the second portion of the front.

9. Apparatus in accordance with claim 7, wherein the port comprises a passive radiator mounted in an opening in the first portion of the front.

10. Acoustic apparatus comprising the combination of:

an enclosure having a front and an opposite rear wall;

a duct of rectangular cross-section disposed within the enclosure and extending from the rear wall to the front of the enclosure, the duct having four sides;

a partition disposed between the interior walls of the enclosure and an outer surface of the duct adjacent the front of the enclosure, the partition having at least one vent therein; and four speakers, each mounted in a different one of the four sides of the duct adjacent the rear wall of the enclosure, wherein the enclosure has an interior volume outside of the duct which combines with the partition having at least one vent therein and the four speakers to form a bass reflex speaker system tuned to a first frequency, and the duct forms a quarterwave resonator tuned to a second frequency higher than the first frequency.

11. Apparatus in accordance with claim 10, wherein the partition is of rectangular configuration with four corners and has four vents therein adjacent the four corners.

12. Acoustic apparatus comprising the combination of:

an enclosure having a front and an opposite rear wall;

a speaker mounted on the rear wall within the enclosure;

a hollow member disposed within the enclosure and extending from the speaker to the front of the enclosure;

a first partition disposed between interior walls of the enclosure and an outer surface of the hollow member at a front of the speaker opposite the rear wall; and a second partition disposed between interior walls of the enclosure and an outer surface of the hollow member adjacent the front of the enclosure, the partition having at least one port therein, wherein the enclosure has an interior volume outside of the hollow member which combines with the second partition and the speaker to form a bass reflex system tuned to a first frequency, and the hollow member forms a quarterwave resonator tuned to a second frequency higher than the first frequency.

13. Apparatus in accordance with claim 12, wherein the at least one port comprises a hollow cylindrical port extending from the second partition toward the rear wall.

14. Apparatus in accordance with claim 12, wherein the second partition is of rectangular configuration with four corners and has four ports therein, each of which comprises a hollow cylindrical member extending outwardly from an aperture in the second partition in a direction toward the rear wall.

* * * * *